United States Patent [19]

Weber et al.

[11] 4,181,502

[45] Jan. 1, 1980

[54] METHOD OF PRODUCING FORM COKE

[75] Inventors: Heinrich Weber, Recklinghausen; Horst Dungs, Herne; Franz Beckmann, Alsdorf, all of Fed. Rep. of Germany

[73] Assignees: Firma Carl Still; Eschweiler Bergwerksverein, both of Fed. Rep. of Germany

[21] Appl. No.: 957,702

[22] Filed: Nov. 6, 1978

[30] Foreign Application Priority Data

Nov. 4, 1977 [DE] Fed. Rep. of Germany ..... 2749408

[51] Int. Cl.[2] ..... C10L 5/00; C21B 5/00; C10B 53/00

[52] U.S. Cl. ..... 44/10 C; 44/10 H; 75/42; 201/21

[58] Field of Search ..... 44/10 R, 10 C, 10 H, 44/10 K; 75/42; 201/22, 21

[56] References Cited

U.S. PATENT DOCUMENTS

| | | | |
|---|---|---|---|
| 3,322,550 | 5/1967 | Murphy | 44/10 R |
| 3,841,849 | 10/1974 | Beckmann | 44/10 H |
| 3,933,443 | 1/1976 | Lohrmann | 44/10 C |
| 4,050,990 | 9/1977 | Lorenz | 201/21 X |

*Primary Examiner*—Carl F. Dees
*Attorney, Agent, or Firm*—McGlew and Tuttle

[57] ABSTRACT

A method of producing form coke, particularly metallurigical coke for a blast furnace, comprises, mixing at least two fine ground coal components, of which one is a non-caking component containing only little of volatile matter and comprises an oil coke, and the other is a caking bituminous coal, and at temperatures corresponding approximately to the softening point of the caking coal component. The mixture is carbonized and pressed to form a briquetted form coke, and the form coke is subsequently hardened.

11 Claims, 1 Drawing Figure

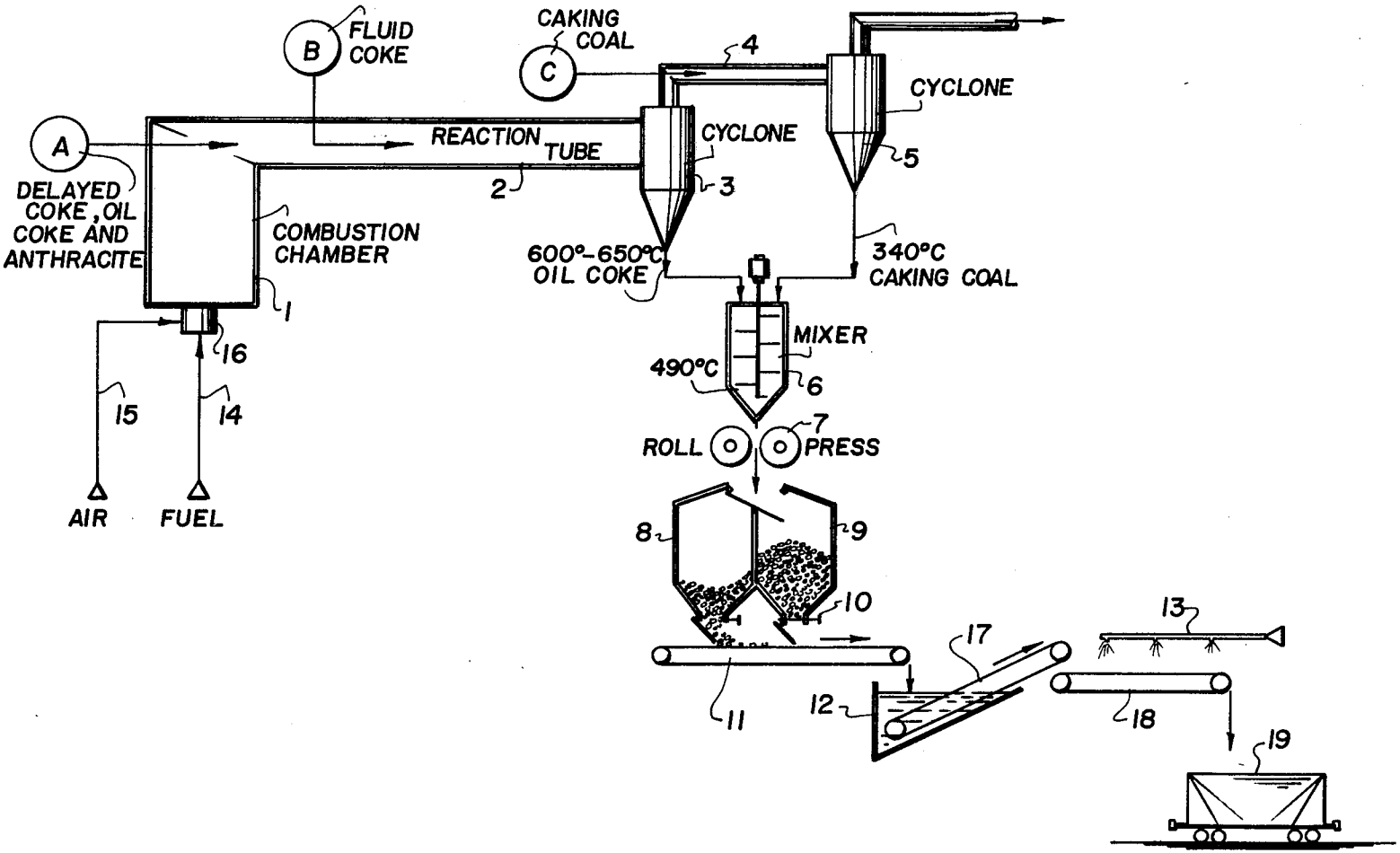
CYCLONE
5
340°C
CAKING COAL
MIXER
6
7
PRESS
9
10
12
17
13
18
19
4
CYCLONE
3
490°C
ROLL
8
11
CAKING COAL
C
600°-650°C
OIL COKE
REACTION TUBE
2
FLUID COKE
B
COMBUSTION CHAMBER
1
16
14
FUEL
15
AIR
A
DELAYED COKE, OIL COKE AND ANTHRACITE

METHOD OF PRODUCING FORM COKE

FIELD AND BACKGROUND OF THE INVENTION

This invention relates to coking in general and, in particular, to a new and useful method of producing form coke, for example, for use as blast furnace coke in the metallurgical industry, using at least two fine grained coal components, of which one is a non-caking basis component containing only little of volatile matter, and the other is a caking bituminous coal, in which the components are mixed with each other at a temperature corresponding approximately to the softening point of the caking coal and the mixture is coked and briquetted, and the form coke is subsequently hardened and cooled.

DESCRIPTION OF THE PRIOR ART

A similar method is known, for example, from German Pat. No. 1,671,377. The said patent discloses a method of manufacturing pressed pieces, particularly fuel briquets, by hot pressing a fine grained mixture of coals softening at the pressing temperature and having a temperature below the softening point, and a substance (inert material) not, or hardly, softening at the pressing temperature and heated to such an extent that the mixture assumes the temperature necessary for the following pressing operation.

In this method, prior to the compacting, the mixture obtained is subjected to a degasification in order to remove volatile matter. This is carried out during a period of time of from one to fifteen minutes and at a temperature of between 450° C. and 530° C., with this period and the temperature being balanced to each other in such a manner that, at the time of forming, the crude tar yield of the briquetted material is lowered to an amount of between 0.07% and 0.2%. The basic component is heated in a hot gas stream and partly degassed, and upon the separation of the basic component, the caking bituminous coal is heated, up to slightly below its softening point, in the same hot gas stream, at a somewhat lower temperature thereof. The coal components are then mixed with each other and the mixture is degassed, pressed, rehardened and cooled.

Another method is known from German Pat. No. 1,915,905, in which the duration of the rehardening operation, also called tempering, is brought into relation with the rehardening temperature. The hot gases used for heating the coal component are produced by burning a solid, liquid or gaseous fuel and they contain a residual amount of oxygen. This manner of producing the hot gases is chosen not least for reasons of economy and the use of, for example, pure nitrogen, which in addition must be heated indirectly would not be acceptable for this very reason.

The oxygen content of the hot gases, however, produces the effect that a part of the heated substances, particularly of the non-caking component, which is heated to a higher temperature than the caking one, is burned and slags. The slag deposits in the heating equipment, for example, the flash heaters, fluidized bed reactors, or even hearth type furnaces, and reduces the cross-sections and the heat transfer, so that a frequent and troublesome manual cleaning is inevitable.

SUMMARY OF THE INVENTION

The present invention is directed to a method of preventing, or substantially reducing, this slagging of the heating equipment during the production of form coke.

In accordance with the invention, a method is provided in which oil coke is substituted for coal as the non-caking basic component. Oil coke has a very low ash content and, consequently, its burning produces a very little amount of slag.

While with the use of non-caking coals having an ash content of from 6 to 7%, the heating equipment of a plant must be cleaned regularly in periods of about 14 days, with the inventive use of oil coke having an ash content of only 0.4%, this necessity occurs only in periods as long as about six months. Thus, due to the invention, the operation is considerably improved and facilitated. A surprising experience has shown that with oil coke as the basic component, a hard form coke, having a strong point resistance to crushing is obtained.

The economically advantageous use of oil coke also results from its flexible application as to the amount and quality, particularly in mixture with bituminous coals which are poor in sulfur. In some countries, such as the United States, oil coke is an undesirable waste product and is available in the entire world at low prices.

It is advisable to use oil coke with 90% of the grain size in the range below 15 mm and to heat it with a gas having a temperature in excess of 1000° C.

The hot gas for heating the oil coke may also be produced by burning oil coke. This particularly simplifies the equipment and material handling for carrying out the inventive method. An advantageous variant of the method provides that oil coke in excess is added to an oxygen containing gas, such as air, and a part of the oil coke is burned so that in this way a hot fly gas stream is produced. In this method, a second, non-caking coal component, for example, fine anthracite, may also be added.

To heat the oil coke, it may be introduced into a fly gas stream sequentially at different locations. The anthracite, for example, may be introduced into the fly gas stream already containing oil coke and both substances may be separated from the fly gas stream together. The method may also be carried out in accordance with German Pat. No. 1,915,505 and in the same fly gas stream, with first the oil coke and the anthracite being heated and, after their separation, the caking bituminous coal may be introduced into the stream and heated.

It is further advantageous to separate the non-caking components; thus, either oil coke alone or oil coke with anthracite, from the fly gas stream while they have a temperature of from 600° C. to 800° C. and to supply them to the mixer.

Depending on the desired porosity of the form coke, an oil coke containing more or less volatile matter may be used. There are two sorts of oil coke on the market, namely, delayed oil coke and fluid oil coke. The delayed oil coke contains more than 9% of volatile matter and the fluid oil coke less than 9%. Delayed coke is a porous coke having thick cell walls. For its use in the hot briquetting process, it is crushed in advance into a grain size of 90% below 15 mm, preferably 90% below 3 mm. Fluid coke contains predominantly fine coke grains with a diameter less than 1 mm. There is no need for preliminary grinding.

Finally, according to the teaching of German Patent No. 1,671,377, the degasification temperature and time in the mixer, while maintaining a degasification temperature of from 450° C. to 530° C., may be balanced relative to each other to obtain a reduction of the crude tar yield at the time of compacting to an amount of 0.07% to 0.2%. Then, after the compacting, no driving forces can occur in the interior of the coke briquet during the after-hardening, which would disintegrate or break open the briquet.

Accordingly, it is an object of the invention to provide a method of producing metallurgical form coke, which comprises, mixing at least two fine ground coal components together, of which one is a non-caking component containing only little of volatile matter and comprising an oil coke, and the other is a caking bituminous coal, and at temperatures corresponding approximately to the softening point of the caking coal component, carbonizing and pressing the mixture to form a briquetted form coke and, subsequently, hardening the form coke.

A further object of the invention is to provide a method which is simple to execute and inexpensive to carry out.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing comprises a schematic representation of an apparatus for carrying out the method of producing form coke in accordance with the invention.

DESCRIPTION OF THE PREFERRED EMBODIMENT

Referring to the drawing in particular, the invention embodied therein, comprises, a method of producing metallurgical form coke from at least two fine ground coal components, of which one is a non-caking component containing only little of volatile matter and comprising an oil coke, and the other is a caking bituminous coal. As seen in the drawing, the components are added at locations A, B and C in a burner device, including a combustion chamber 1, in which the hot gases are directed through a reactor tube 2.

In accordance with the invention, the following starting substances are used:

1. 48% of delayed coke containing 1.4% of sulfur and 11% of volatile matter (wf);
2. 25% of fluid coke containing 2% of sulfur and 6% of volatile matter (wf); and
3. 27% of binder coal with 0.9% of sulfur and 25% of volatile matter (waf) and 6% ash (wf).

The heat necessary for the process is produced in a combustion chamber 1 by means of external energy. A fuel supply line is shown at 14 and an air line 15 to a burner 16. First, delayed coke A is blown into the hot combustion gases flowing from combustion chamber 1 into a reactor tube 2. Then, fluid coke B is added in about the mid-portion of reactor tube 2. The hot combustion gases heat the two coke components up to from 600° C. to 650° C. within tenths of seconds.

The solid matter is separated from the combustion gases in a cyclone 3. The hot combustion gases having a temperature of from 700° C. to 800° C. pass into a reactor tube 4, into which the caking coal C is blown and heated to a temperature of about 340° C. The caking coal separated in cylone 5 passes into a mixer 6 where it is intensely mixed with the oil coke from cyclone 3. At the temperature of 490° C. assumed by the mixture, the binder coal softens and binds the inert component.

During a period of dwell in the mixer of from five to seven minutes, the briquetting material becomes detarred to a large extent. The briquetting material passes from mixer 6 to a roll press 7. Immediately after the press 7, the hot briquets have a temperature of from 500° C. to 505° C. With this temperature, they are delivered, over a short transfer path, to hardening bins 8 and 9. In these bins, the autothermal low tempeature after carbonization is accomplished within three to four hours and the product is consolidated. The finished product is discharged from the bins through outlets 10 and by a conveyor 11 to a water bath 12 and from there, it is transported by a conveyor 17 to a conveyor 18 for cooling by a sprayer 13 and then loaded into cars 19.

The finished form coke contains about 7% of volatile matter, about 2.15% ash and about 1.4% of sulfur. Its volume of voids is about 30% to 35%.

In this example, the dry waste gas of cyclone 5 has a calorific value of about 800 kcal/Nm$^3$. If the amount of fuel in combustion chamber 1 is reduced without reducing the oxygen supply, the deficient amount of heat is covered by the partial combustion of the delayed coke, without slag depositing in reactor tube 2. The calorific value of the dry waste gas from cyclone 5 drops, at the same time, to about 500 kcal/Nm$^3$.

The materials and amounts mentioned in the example may be varied within wide ranges. By reducing the delayed coke proportion to 35–25%, and correspondingly, increasing the fluid coke amount, the volume of voids is reduced by about 4–8%. While the proportion of volatile matter drops by only 0.3% to 0.5%, the sulfur and ash contents correspond approximately to the sume of the materials used. By substituting delayed coke for the fluid coke, the volume of voids can be increased by from 3% to 5% under otherwise same conditions.

Instead of the oil coke as the second non-caking coal component, anthracite, for example, may be added at the blow location B. In such a case, the oil coke blown in at A is separated in cyclone 3 along with the anthracite which has been heated in the same combustion gas stream, and delivered to mixer 6. In order to change the product in a desired manner, in addition, it is also possible to introduce a mixture of oil coke and anthracite at the blow location A, and only anthracite or a mixture of oil coke and anthracite at B.

While a specific embodiment of the invention has been shown and described in detail to illustrate the application of the principles of the invention, it will be understood that the invention may be embodied otherwise without departing from such principles.

What is claimed is:

1. A method of producing metallurgical form coke, comprising, mixing at least two fine ground coal components together, of which one is a non-caking component containing only little of volatile matter and comprises an oil coke, and the other is a caking bituminous coal, the mixing being carried out at a temperature corresponding approximately to the softening point of the caking coal component, carbonizing and pressing the mixture to form a briquetted form coke, and subsequently, hardening the form coke.

2. A method of producing metallurgical form coke, as claimed in claim 1, wherein said oil coke consists of grains, 90% of which are of a size range of less than 15 mm.

3. A method of producing metallurgical form coke, as claimed in claim 1, wherein the oil coke is preheated by burning a combustion waste gas which has been heated to a temperature of more than 1000° C.

4. A method of producing metallurgical form coke, as claimed in claim 3, wherein the oil coke is partly burned with an oxygen-containing gas to effect the preheating and the oil coke in excess is heated and mixed with the caking coal component.

5. A method of producing metallurgical form coke, as claimed in claim 4, wherein a hot fly gas stream is used for preheating the oil coke.

6. A method of producing metallurgical form coke, as claimed in claim 1, wherein a fine grain anthractie is used as the non-caking component.

7. A method of producing metallurgical form coke, as claimed in claim 5, wherein the oil coke is introduced into the hot fly gas stream.

8. A method of producing metallurgical form coke, as claimed in claim 5, wherein anthractie is introduced into the same fly gas stream and the two components are separated from the fly gas stream together.

9. A method of producing metallurgical form coke, as claimed in claim 6, wherein after separation of the oil coke, the caking coal component is preheated in the same gas fly stream.

10. A method of producing metallurgical form coke, as claimed in claim 9, wherein the oil coke or the mixture of oil coke and anthracite is separated from the fly gas stream while having a temperature of from 600° C. to 800° C. and is subsequently mixed with the other component.

11. A method of producing metallurgical form coke, as claimed in claim 1, wherein the mixture of components has a temperature necessary for compacting and is subjected prior to compacting to a degasification to remove volatile matter which is carried out during a period of time of from one to five minutes and at a temperature of from 450° C. to 530° C., with this period and temperature being balanced relative to each other in such a manner that, at the time of compacting, the crude tar yield of the briquetted material is lowered to an amount of between 0.07 and 0.2%.

* * * * *